United States Patent [19]

Keough

[11] Patent Number: 5,009,321

[45] Date of Patent: Apr. 23, 1991

[54] SORTING SYSTEM FOR ORGANIZING RANDOMLY ORDERED ROUTE GROUPED MAIL IN DELIVERY ORDER SEQUENCE

[75] Inventor: Laurence J. Keough, Fairfield, Conn.

[73] Assignee: Pitney Bowes Inc., Stamford, Conn.

[21] Appl. No.: 434,734

[22] Filed: Nov. 13, 1989

[51] Int. Cl.[5] ..... B07C 5/02

[52] U.S. Cl. ..... 209/3.1; 209/584; 209/900

[58] Field of Search ..... 209/3.1-3.3, 209/583, 584, 569, 900, 552, 564, 568; 364/478; 382/1, 57

[56] References Cited

U.S. PATENT DOCUMENTS

| | | | |
|---|---|---|---|
| 3,184,061 | 5/1965 | Levy | 209/552 |
| 3,261,464 | 7/1966 | Levy | 209/552 |
| 3,573,748 | 4/1971 | Holme | 340/172.5 |
| 4,247,008 | 1/1981 | Dobbs | 209/569 |
| 4,388,994 | 6/1983 | Suda et al. | 209/564 |
| 4,554,873 | 11/1985 | Rex | 104/88 |
| 4,566,595 | 1/1986 | Fustier | 209/545 |
| 4,601,396 | 7/1986 | Pavie | 209/569 |
| 4,611,280 | 9/1986 | Linderman | 364/300 |
| 4,632,252 | 12/1986 | Haruki et al. | 209/900 X |
| 4,641,753 | 2/1987 | Tamada | 209/546 |
| 4,778,062 | 10/1988 | Pavie et al. | 209/900 X |

FOREIGN PATENT DOCUMENTS

| | | |
|---|---|---|
| 0099434 | 1/1984 | European Pat. Off. . |
| 0281007 | 7/1988 | European Pat. Off. . |

*Primary Examiner*—Donald T. Hajec

*Attorney, Agent, or Firm*—Charles R. Malandra, Jr.; David E. Pitchenik; Melvin J. Scolnick

[57] ABSTRACT

A multiple-pass sorting system for sorting mail pieces in a sequence corresponding to a mail carrier's route includes storage media for storing a database containing a delivery sequence for each address on the carrier's route. As mail pieces to be delivered by the carrier are fed into the system, each of the mail pieces are transported to an multiline optical character reader (MLOCR) which reads the address printed on the mail piece. A processor operatively connected to the MLOCR and the storage media determines the sorting sequence representative of the delivery order sequence for each of the mail pieces. The mail pieces are sorted into sorting bins based on a first pass sorting scheme. Subsequent sort passes are required until the mail pieces are in delivery order sequence.

10 Claims, 7 Drawing Sheets

FIG. 5

| CARRIER ROUTE STOP NUMBER | ZIP+4 | ADDRESS |
|---|---|---|
| 1 | 06430-0001 | 40 WOODBINE LANE |
| 2 | 06430-0001 | 44 WOODBINE LANE |
| 3 | 06430-0001 | 48 WOODBINE LANE |
| 4 | 06430-0003 | 50 WOODBINE LANE |
| 5 | 06430-0003 | 54 WOODBINE LANE |
| 6 | 06430-0005 | 60 WOODBINE LANE |
| 7 | 06430-0007 | 70 WOODBINE LANE |
| 8 | 06430-0007 | 76 WOODBINE LANE |
| 9 | 06430-0008 | 77 WOODBINE LANE |
| 10 | 06430-0008 | 75 WOODBINE LANE |
| 11 | 06430-0008 | 71 WOODBINE LANE |
| 12 | 06430-0872 | 100 JEFFERSON STREET |
| 13 | 06430-0872 | 104 JEFFERSON STREET |
| 14 | 06430-0872 | 108 JEFFERSON STREET |
| 15 | 06430-0862 | 109 JEFFERSON STREET |
| 16 | 06430-0862 | 107 JEFFERSON STREET |
| 17 | 06430-0862 | 103 JEFFERSON STREET |
| 18 | 06430-0006 | 63 WOODBINE LANE |
| 19 | 06430-0852 | 100 ADAMS STREET |
| 20 | 06430-0852 | 102 ADAMS STREET |
| 21 | 06430-0852 | 108 ADAMS STREET |
| 22 | 06430-0842 | 107 ADAMS STREET |
| 23 | 06430-0842 | 105 ADAMS STREET |
| 24 | 06430-0004 | 57 WOODBINE LANE |
| 25 | 06430-0004 | 53 WOODBINE LANE |
| 26 | 06430-0832 | 100 WASHINGTON STREET |
| 27 | 06430-0832 | 104 WASHINGTON STREET |
| 28 | 06430-0832 | 108 WASHINGTON STREET |
| 29 | 06430-0153 | 50 CHERRY STREET |
| 30 | 06430-0153 | 52 CHERRY STREET |
| 31 | 06430-0153 | 58 CHERRY STREET |
| 32 | 06430-0155 | 64 CHERRY STREET |
| 33 | 06430-0157 | 70 CHERRY STREET |
| 34 | 06430-0157 | 76 CHERRY STREET |
| 35 | 06430-0158 | 75 CHERRY STREET |
| 36 | 06430-0156 | 65 CHERRY STREET |
| 37 | 06430-0154 | 57 CHERRY STREET |
| 38 | 06430-0154 | 53 CHERRY STREET |
| 39 | 06430-0822 | 107 WASHINGTON STREET |
| 40 | 06430-0822 | 105 WASHINGTON STREET |
| 41 | 06430-0822 | 103 WASHINGTON STREET |
| 42 | 06430-0002 | 47 WOODBINE LANE |
| 43 | 06430-0002 | 43 WOODBINE LANE |

SORTING SYSTEM FOR ORGANIZING RANDOMLY ORDERED ROUTE GROUPED MAIL IN DELIVERY ORDER SEQUENCE

RELATED APPLICATIONS

Reference is made to copending application of the same inventor, entitled "Sorting System For Organizing In One Pass Randomly Ordered Carrier Route Grouped Mail In Delivery Order Sequence" Docket No. C-583 concurrently filed herewith and assigned to Pitney Bowes Inc.

FIELD OF THE INVENTION

This invention relates to sorting system for use in arranging mail pieces according to a delivery sequence in a carrier's delivery route, commonly referred to as a "carrier walk sequence."

BACKGROUND OF THE INVENTION

The volume of mail handled on a daily basis by carriers, as for example, the U.S. Postal Service, is such that automated handling and sorting equipment is employed whenever and wherever possible to facilitate the distribution of mail pieces. Mail pieces include letters, flats, irregular parcel pieces, and parcels which are delivered by individual mail carriers. Various automated sorting techniques, systems and methods for processing mail are well known. Presently automated sorting systems can sort mail pieces down to an individual mail carrier at a local post office, commonly referred to as carrier route sorting. However, no automated sorting system exists that would provide a sort producing delivery sequenced mail, i.e., mail arranged to a carrier walk sequence. The term mail carrier, as used herein, refers to the person who delivers mail to residences and businesses within a local (city or rural) area.

Database files containing carrier route identification based on nine digit zip codes, or ZIP+4, are used by the Postal Service in the automated carrier route sorting. The Postal Service makes the carrier route database files available to mailers, such as third class mailers. The mailers use the carrier route database files to print the mail pieces in a pre-sorted order according to carrier routes. The postal services in return provides a discount in postal rates for mailers delivering mail pieces in such a presorted order. Mail pieces sorted to a carrier route are in no particular order with regard to a carrier walk sequence.

Postal services use various sorting schemes and techniques. Presently in the United States, automated sorting down to a carrier walk sequence for a given carrier route does not exist for any kind or class of mail. The most recent automated system used by the U.S. Postal Service for receiving and sorting mail is a system utilizing an optical character reader/channel sorter (OCRCS). One of the functions normally performed by the OCRCS system is a primary sort based on the first two or three digits of a zip code. Another function of the OCRCS system is to extract information from the mail piece and print the information on the mail piece in machine readable form. The information typically extracted form a nine digit ZIP CODE, or ZIP+4. If the ZIP+4 is not printed on the mail piece, the OCRCS system can determine the ZIP+4 by recognizing the address printed on the mail piece and comparing the recognized address to information contained in a Zip Code database.

Once the ZIP+4 is determined the OCRCS system prints the ZIP+4 in bar code form on the mail piece. At the completion of the primary sorting, a secondary sort is performed on the mail pieces. Typically, the secondary sorting is done by a bar code sorter which reads and sorts by the ZIP+4 bar code printed by the OCRCS system. Based on the information contained in the ZIP+4, described below, the bar code sorter can sort to a carrier route level using the carrier route database files. Some mail pieces are rejected by the OCRCS system because the ZIP+4 cannot be determined, for example, mail pieces having handwritten addresses. Such mail pieces are handled by a multi position letter sorter machine, where operators enter information required for automated carrier route sorting.

The ZIP+4 provides information down to a carrier route level. The first five digits provide state, city and local post office identification. The +4 digits provide "block face" identification, i.e., sector and segment within a delivery area of a local post office. It can be appreciated that the ZIP+4 can be used to sort down to a mail carrier level using existing databases. It is understood that ZIP+4 does not contain enough information to allow a sort down to carrier walk sequence.

The final sorting of the mail pieces is to a carrier walk sequence. Generally, mail pieces delivered to a local post office for delivery to a final destination, have already been sorted to a carrier route level. Mail pieces within each carrier route grouped mail are in no particular order. The sorting to a carrier walk sequence is usually performed by an individual mail carrier and is always done manually. The manual sorting technique used by the mail carrier is commonly referred to as "casing" the mail. The mail carrier takes each mail piece sorted to the carrier's route, reads a mailing address on the mail piece and places the mail piece into a "case", which is a piece of equipment containing many pigeonholes, in an order consistent with the order of the delivery stops on the carrier's route. The manual task of casing the mail is labor intensive, typically requiring three to four hours per day for each carrier route. This can be as much as one half of a mail carrier's work day. It can be appreciated that this manual method of reading the mailing address on each mail piece and then hand sorting each mail piece to a carrier walk sequence is subject to errors.

It is an object of the present invention to provide a system which would greatly improve the efficiency of sorting randomly ordered carrier route grouped mail pieces.

It is a further object of the present invention to reduce or eliminate the labor intensive hand sorting process by mail carriers at a local post office.

It is a another object of the present invention to shorten the time required to deliver mail by reducing the time required to process mail pieces in preparation for physical delivery and to avoid individual carrier handling errors while sorting in delivery order sequence.

SUMMARY OF THE INVENTION

It has been discovered that a carrier walk sequence database can be utilized with a sorting system in a particular manner to achieve the above objectives for mail which has been processed down to a mail carrier route level, but which is still in random delivery order.

It has also been discovered that the capability of mail sorting equipment can be expanded by determining and printing a delivery sequence code as part of the sorting process so that the equipment can further process the same mail for sorting to a carrier walk sequence.

According to the present invention, a system is provided for sorting mail pieces in a sequence corresponding to a carrier walk sequence. The system includes storage media for storing a database containing a delivery sequence for each address on the carrier's route. Means are provided for feeding into the system the mail pieces to be delivered by the carrier and further means are provided for reading an address on each of the mail pieces. Means are operatively connected to the reading means and the storing means, for determining a sorting sequence representative of the carrier walk sequence for each of the mail pieces. Sort means operatively connected to the determining means deposit the mail pieces into sorting bins in accordance with the sorting sequence.

In accordance with a feature of the present invention means are provided for printing a sequence code corresponding to the sorting sequence representative of the carrier walk sequence on each of the mail pieces.

BRIEF DESCRIPTION OF THE DRAWINGS

A complete understanding of the present invention may be obtained from the following detailed description of the preferred embodiment thereof, when taken in conjunction with the accompanying drawings wherein like reference numerals designate similar elements in the various figures and, in which:

FIG. 5 is a sample directory relating to the carrier route of FIG. 4, helpful in understanding the present invention.

DETAILED DESCRIPTION OF THE INVENTION

Figure 1:
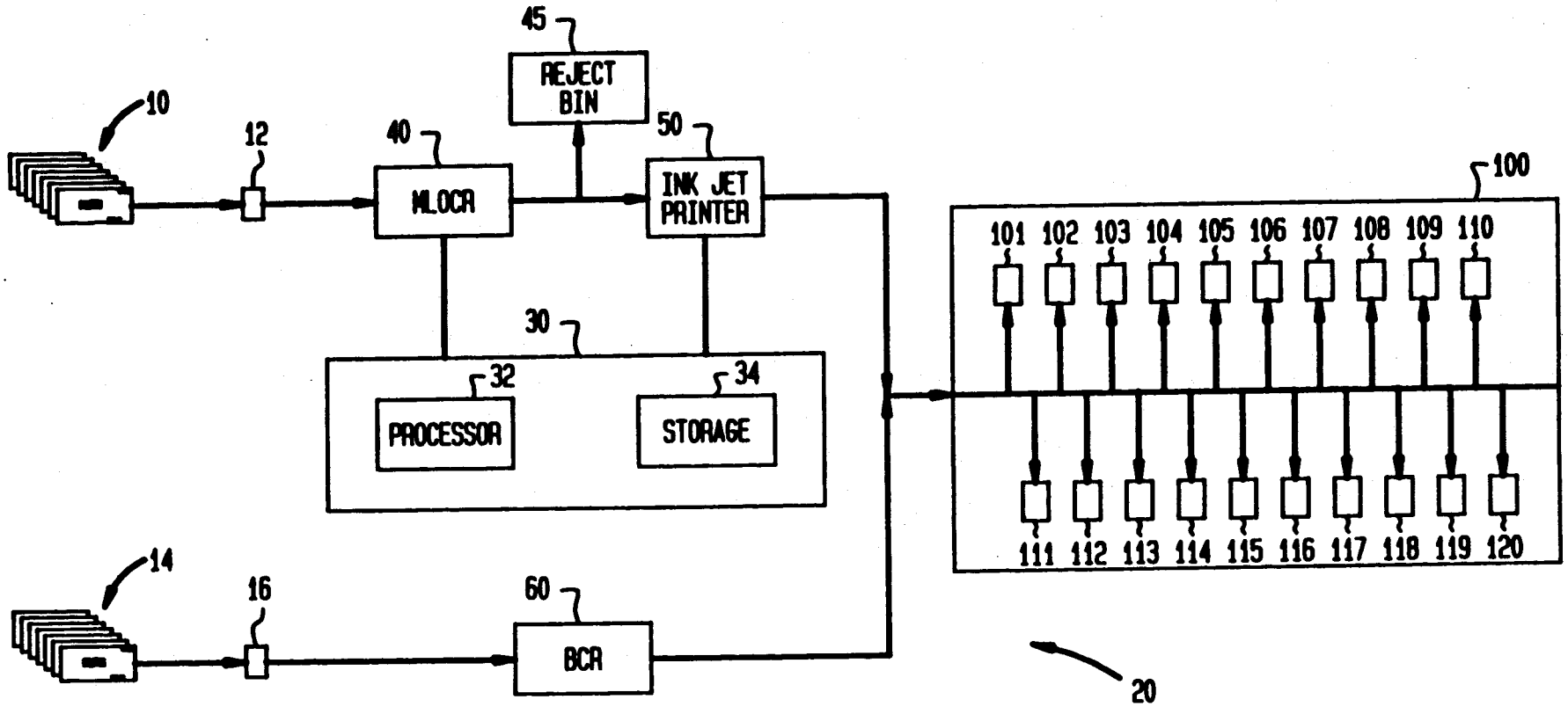
FIG. 1 is a diagrammatic representation of a sorting system for organizing randomly ordered route grouped mail in carrier walk sequence, which embodies the present invention.

A typical individual mail carrier for the U.S. Postal Service has many stops in the delivery of mail along the carrier's route. The number of stops can vary extensively depending on the particular route and location of the route, e.g., urban, suburban or rural. For the purpose of the following description of the various figures, it is assumed that sorting to a carrier walk sequence will take place at a local post office and that the number of delivery stops for any mail carrier at the local post office will not exceed 400. In the preferred embodiment of the present invention, the carrier route sorting is completed in two passes as described below.

Referring now to FIGURE mail pieces 10 have been presorted in some manner, for example by the OCRCS system described above, and represent mail pieces to be delivered by one of the local mail carriers. Mail pieces 10 are in no particular order with respect to the carrier walk sequence of the mail carrier. When mail pieces 10 are received at a local post office, mail pieces 10 are fed into mail sorting system 20 which is controlled by computer system 30. Computer system 30 consists of processor 32 for controlling mail sorting system 20 and storage media 34 containing a carrier walk sequence database, described below, for various carrier routes of the local post office. Mail piece 12 represents one of mail pieces 10 transported through mail sorting system 20.

Figure 2A:
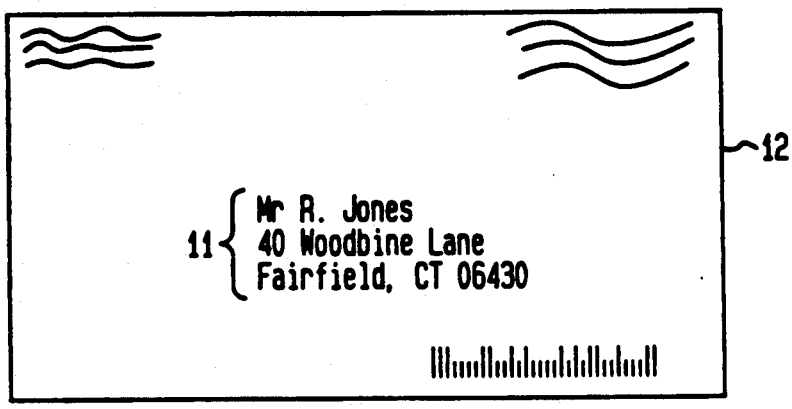
FIG. 2*a* shows the front side of a mail piece containing a mailing address and a bar code representing a nine digit ZIP code.
Figure 2B:
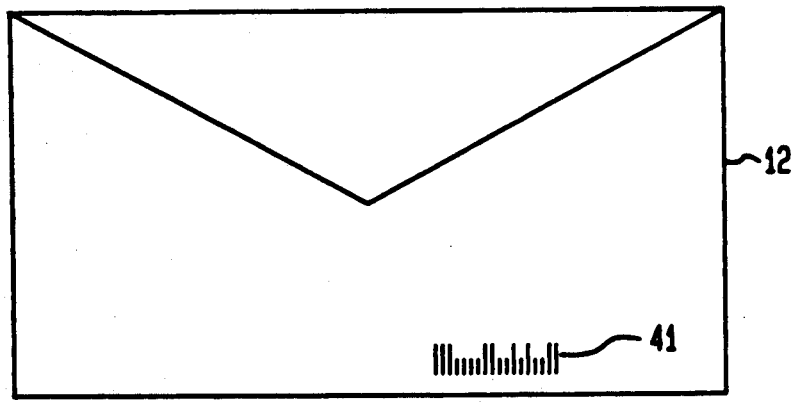
FIG. 2*b* shows the back side of a mail piece containing a bar code representing the delivery sequence code.

As mail piece 12 is transported past multiline optical character reader (MLOCR) 40, address 11 (FIG. 2*a*) printed on mail piece 12, if it is in machine readable form, is read and sent to processor 32. Processor 32 retrieves from the storage media 34 a database file containing addresses of the mail stops on the carrier's route and corresponding delivery data such as carrier walk sequence numbers. Processor 32 determines the carrier walk sequence number for mail piece 12 by matching the address read by MLOCR 40 to an address in the database file. If the address on mail piece 12 is not in machine readable form, mail piece 12 is diverted into reject bin 45. Mail piece 12 is transported to ink jet printer 50 where an appropriate sequence code 41 (FIG. 2*b*) corresponding to the carrier walk sequence number is printed on the mail piece 12. In the preferred embodiment of the present invention, sequence code 41 is a code, for example a three character code, representing the carrier walk sequence number and is printed in the form of a bar code on the back of mail piece 12. This facilitates the reading of the carrier walk sequence number in the second pass sort, as is explained in greater detail hereinafter, by bar code reader 60. printing on the back of mail piece 12 provides an advantage in that it is easily distinguishable from any bar code printed by earlier sorting systems. It will be understood that the carrier walk sequence number could be printed in alpha numeric form on mail piece 12. This, however, would required a second pass reading by MLOCR 40 which would slow down the sorting process. The use of a relatively inexpensive bar code reader 60 provides a fast an efficient second pass sort. It will also be understood that a four character code could be used if more than one thousand stops are in any mail carrier's route. It will be appreciated that other printing than bar codes, such as dash codes, could be beneficially employed with the present system.

After sequence code 41 is printed, mail piece 12 is transported to sorting station 100 having a plurality of sorting bins, such as those at 101–120. The number of sorting bins required for mail sorting system 20 depends on the factors of a formula $X=Y^n$, where X is the number of delivery stops on a carrier route, Y is the number of sorting bins available in the mail sorting system, and n is the number of passes required for the sort.

If, for example, the number of delivery stops for any mail carrier at the local post office does not exceed four hundred, and twenty sorting bins 101–120 are available in the mail sorting system 20 with each bin having a capacity of mail pieces for at least twenty delivery stops, in accordance with the formula $X=Y^n$, the carrier walk sequence sort is completed in a two passes.

During processing at sorting station 100, the mail piece 12 is deposited into one of sorting bins 101-120 under the control of processor 32. As mail piece 12 passes the one of sorting bins 101-120, for example, sorting bin 110, having an assigned carrier walk sequence number corresponding to the sequence code of mail piece 12, mail piece 12 is deposited into sorting bin 110. In the preferred embodiment of the present invention, sorting bins 101-120 are assigned with the first pass sort stop numbers listed in Table 1. For example, mail pieces having sequence code 22 will be deposited into bin 102, mail pieces having sequence code 65 will be deposited into bin 105 and mail pieces having sequence code 377 will be deposited into bin 117. When all mail pieces 10 have been sorted in accordance with the first pass sort schemes listed in Table 1, sorting bins 101-120 are all emptied such that the integrity of the first pass sort is maintained, that is the sequence integrity of each of sort bins 101-120 is retained with the mail pieces from bin 101 being followed in order by the mail pieces from bins 102 through 120.

The first pass sort mail form a batch of mail pieces 14 which are then fed through the system again via bar code reader 60. Mail piece 16 is one of the first pass sorted mail pieces in the batch of mail pieces 14. For the second pass sort, sorting bins 101-120 are reassigned with the final sorting scheme as listed in Table 2. For example, during the second pass sort mail pieces having sequence codes 22, 65 and 377 will be deposited into bins 102, 104 and 119 respectively.

The sort schemes listed in Tables 1 and 2 apply to a sorting system handling 400 mail stops and having twenty sorting bins. It will be appreciated that the present invention can handle any combination in the amount of mail stops and sorting bins. The following is a general description of the first and second pass sorting schemes for the preferred embodiment of the present invention. In the first pass sort with Y representing the total number of sort bins and S representing each sort bin, the mail pieces containing sequence codes $Y \times Z)+S-Y$ are deposited into bins S, with Z equal to 1 through Y. For example, with Y=20, for bin 9, sequence codes 9, 29, 49, 69 . . . 369, and 389 would be assigned to bin 9. In the second pass sort, for X number of stops on a carrier's route and Y number of sorting bins, mail pieces having sequence codes of 1 through [X/Y] are deposited into bin 1, mail pieces having sequence codes of [X/Y]+1 through 2 [X/Y] are deposited into bin 2. This sequence progression continues until mail pieces having sequence codes (Y−1) [X/Y] through X are deposited into bin Y. It will be understood by those skilled in the art that [X/Y] denotes the next higher integer to X/Y if X/Y is not an integer. For example if X=433 and Y=20, [X/Y]=22. This notation is known as a "ceiling".

TABLE 1

| FIRST PASS BIN ASSIGNMENTS | |
|---|---|
| Bin | Carrier Walk Sequence Number |
| 101 | 1, 21, 41, 61, . . . , 381 |
| 102 | 2, 22, 42, 62, . . . , 382 |
| 103 | 3, 23, 43, 63, . . . , 383 |
| 104 | 4, 24, 44, 64, . . . , 384 |
| 105 | 5, 25, 45, 65, . . . , 385 |
| 106 | 6, 26, 46, 66, . . . , 386 |
| 107 | 7, 27, 47, 67, . . . , 387 |
| 108 | 8, 28, 48, 68, . . . , 388 |
| 109 | 9, 29, 49, 69, . . . , 389 |
| 110 | 10, 30, 50, 70, . . . , 390 |
| 111 | 11, 31, 51, 71, . . . , 391 |

TABLE 1-continued

| FIRST PASS BIN ASSIGNMENTS | |
|---|---|
| Bin | Carrier Walk Sequence Number |
| 112 | 12, 32, 52, 72, . . . , 392 |
| 113 | 13, 33, 53, 73, . . . , 393 |
| 114 | 14, 34, 54, 74, . . . , 394 |
| 115 | 15, 35, 55, 75, . . . , 395 |
| 116 | 16, 36, 56, 76, . . . , 396 |
| 117 | 17, 37, 57, 77, . . . , 397 |
| 118 | 18, 38, 58, 78, . . . , 398 |
| 119 | 19, 39, 59, 79, . . . , 399 |
| 120 | 20, 40, 60, 80, . . . , 400 |

TABLE 2

| FINAL SORTING SCHEME | |
|---|---|
| Bin | Carrier Walk Sequence Number |
| 101 | 1, 2, 3, 4, . . . , 20 |
| 102 | 21, 22, 23, 24, . . . , 40 |
| 103 | 41, 42, 43, 44, . . . , 60 |
| 104 | 61, 62, 63, 64, . . . , 80 |
| 105 | 81, 82, 83, 84, . . . , 100 |
| 106 | 101, 102, 103, 104, . . . , 120 |
| 107 | 121, 122, 123, 114, . . . , 140 |
| 108 | 141, 142, 143, 144, . . . , 160 |
| 109 | 161, 162, 163, 164, . . . , 180 |
| 110 | 181, 182, 183, 184, . . . , 200 |
| 111 | 201, 202, 203, 204, . . . , 220 |
| 112 | 221, 222, 223, 224, . . . , 240 |
| 113 | 241, 242, 243, 244, . . . , 260 |
| 114 | 261, 262, 263, 264, . . . , 280 |
| 115 | 281, 282, 283, 284, . . . , 300 |
| 116 | 301, 302, 303, 304, . . . , 320 |
| 117 | 321, 322, 323, 324, . . . , 340 |
| 118 | 341, 342, 343, 344, . . . , 360 |
| 119 | 361, 362, 363, 364, . . . , 380 |
| 120 | 381, 382, 383, 384, . . . , 400 |

From Tables 1 and 2 and FIG. 1 it will be understood that the order in which mail pieces 14 are sorted during the second pass depends on the order mail pieces 14 are fed. To achieve a second pass sort where carrier walk sequence number 1 is at the top of or front of bin 101, the mail pieces 14 should be feed in reverse order, i.e., bin 20, bin 19, . . . bin 1. After the second sorting pass is completed, sorting bins 101-120 contain the mail pieces sorted in a carrier walk sequence.

Figure 3:
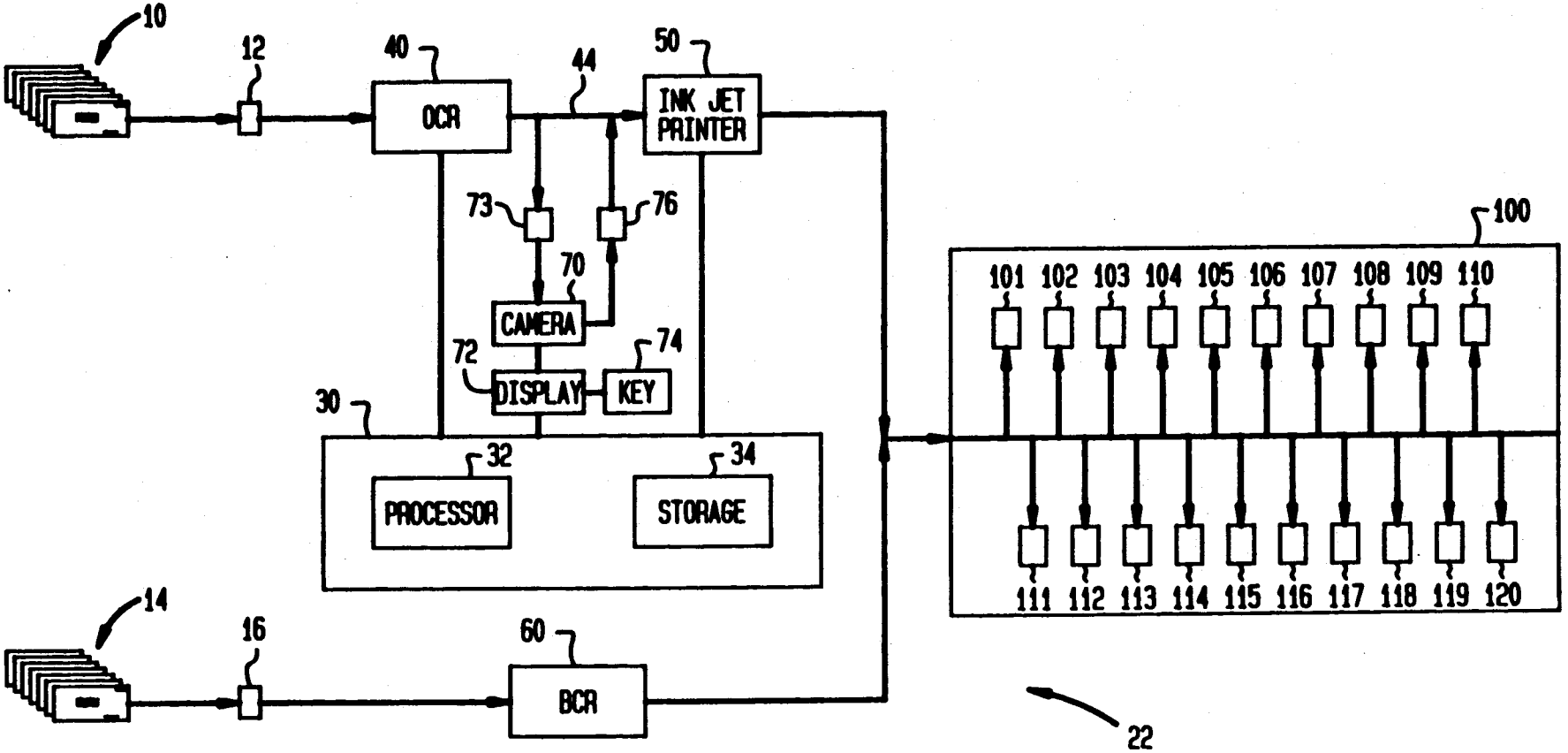
FIG. 3 is a diagrammatic representation of the sorting system in FIG. 1 with a camera, display and keyboard added to facilitate the processing of mail with non-machine readable addresses.

The only manual sorting remaining for an individual mail carrier is for the mail pieces which were not machine readable. Referring to FIG. 3, this manual process can be eliminated by replacing reject bin 45 (FIG. 1) with a camera 70, display 72 and keyboard 74. In sorting system 22, when the MLOCR 40 cannot read the address on mail piece 12, mail piece 12 is diverted to camera 70 which displays the address on display 72. An operator reads the address on display 72 and enters the address through keyboard 74. Using the address entered by the operator processor 32 determines the sequence code in the same manner as if the MLOCR 40 had read the address. This interactive method of handling non-machine readable addresses will not delay the reading of machine readable addresses because the interactive determination of the sequence code is done in parallel to the reading by MLOCR 40. The interactive processing of a mail piece having a non-machine readable address is performed off the main transport path 44. Once the sequence code is determined, the non machine readable mail piece is merged with the machine readable mail piece on main transport path 44 and is transported to ink jet printer 50 for sequence code printing. Holding buffers 73 and 76 are for temporary storage of non machine readable mail pieces diverted for the interactive process described above. Buffer 73 holds diverted mail pieces waiting to be transported to camera 70. Buffer 76 holds mail pieces waiting to be merged onto main transport path 44.

Figure 4:
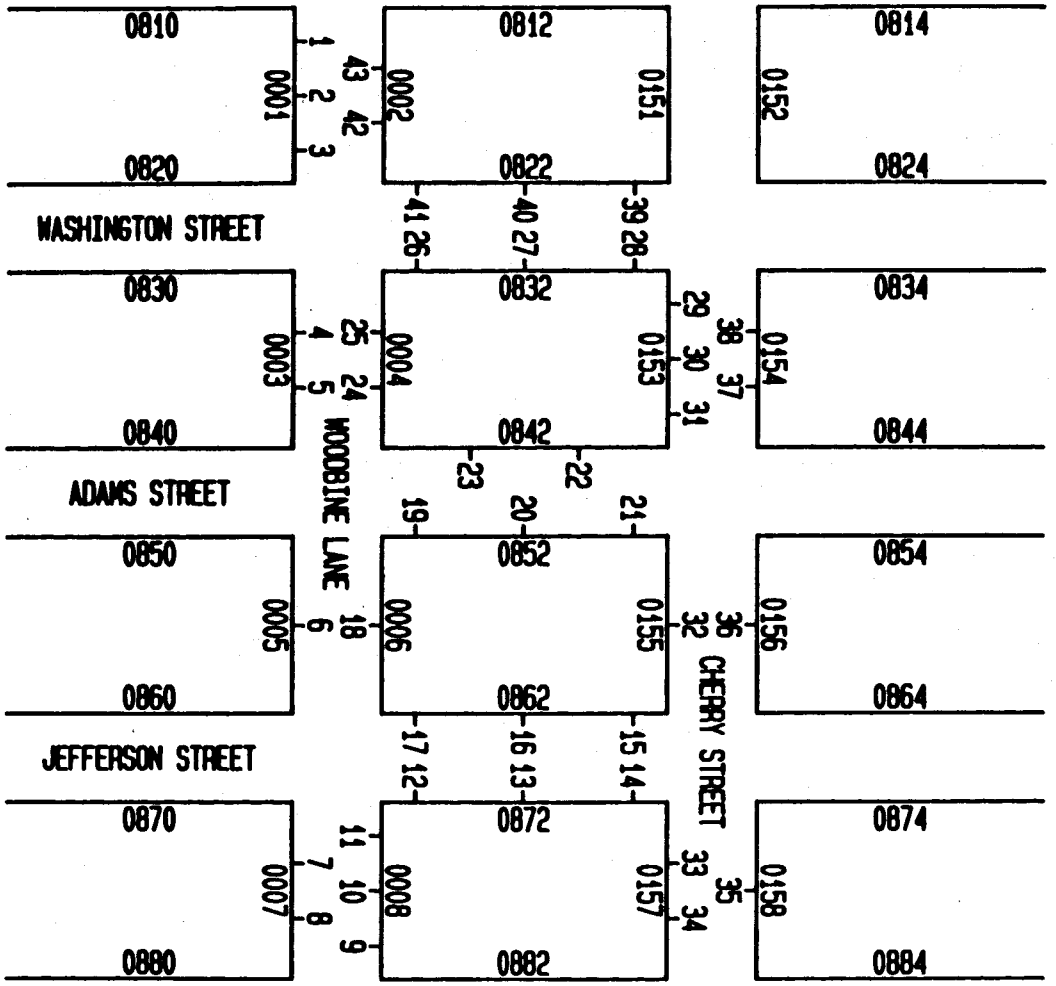
FIG. 4 is a diagram showing an example of a carrier walk sequence versus the last 4 digits of a nine digit Zip Code.

Referring now to FIG. 4, a typical nine digit zip code (ZIP+4) block face diagram is shown. The diagram illustrates a typical mail carrier walk sequence. The four digit number inside each block represents the "+4" part of the ZIP+4. The numbers 1 through 43 on the outside of each block represent the carrier's walk sequence. It will be understood by those skilled in the art that further sorting is required beyond the ZIP+4 sorting to obtain mail pieces sorted in the delivery order sequence of the carrier's route. The systems shown in FIGS. 1 and 3 process the mail so that further sorting to a carrier walk sequence can be obtained.

Referring now to FIG. 5, an example of one form of file containing the directory for the mail carrier walk sequence illustrated in FIG. 4 is shown. It will be appreciated from FIG. 5 that because there is no correlation between the ZIP+4 number and the carrier walk sequence, a further sort using the entire address is required.

Figure 6:
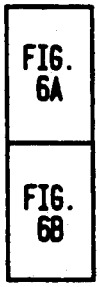
FIGS. 6, 6A and 6B are flow charts of the sorting system for organizing randomly ordered route grouped mail into a carrier walk sequence.
Figure 6A:
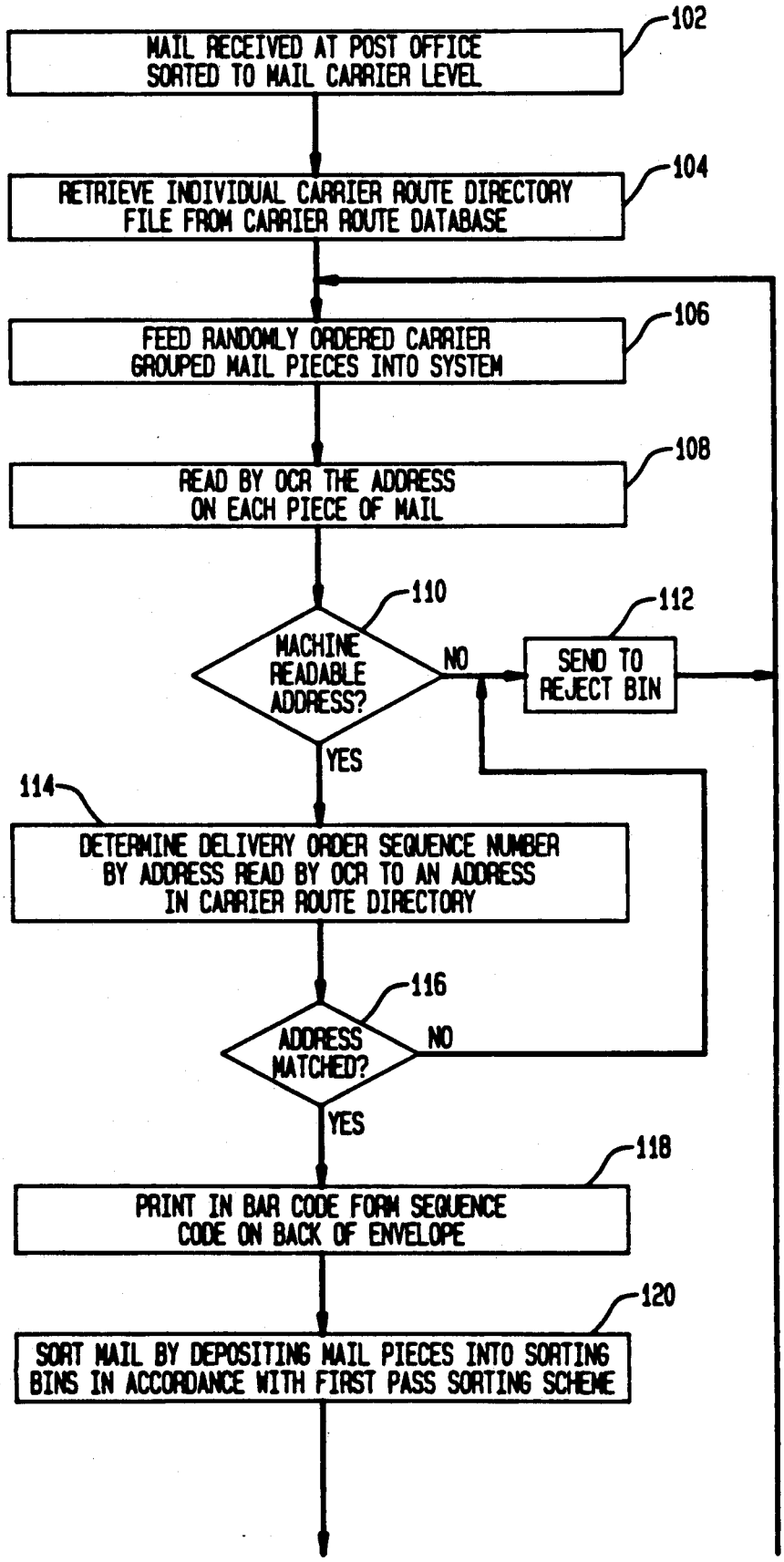
Figure 6B:
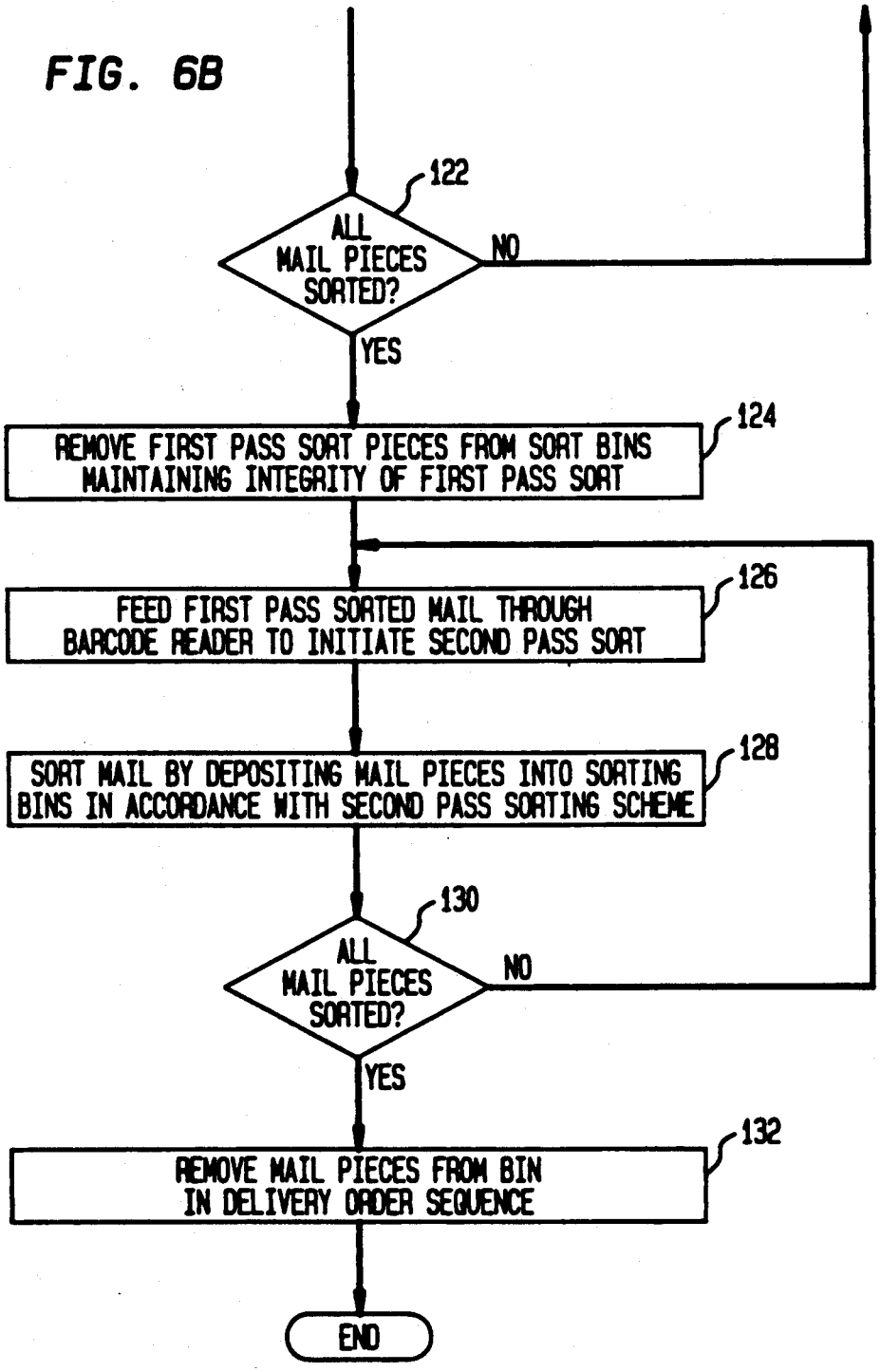

In FIG. 6, a flow chart describing a two pass sorting system embodiment of the present invention is shown. At block 102, mail pieces sorted to mail carrier level are received at a local post office. At block 104, the carrier route directory file is retrieved from a carrier route database. At block 106, randomly ordered carrier grouped mail pieces are fed into the sorting system. At block 108, the address on each mail piece is read by MLOCR. At block 110, if the address is not in machine readable form the mail piece is diverted to the reject bin at block 112. If the address is machine readable, at block 114, determine the carrier walk sequence number for the mail piece by comparing the address read by the MLOCR to an address in the carrier route directory. At block 116, if the MLOCR read address does not match any address in the directory divert the mail pieces to the reject bin at block 112. If a match is found, at block 118 print a sequence code in bar code form on the mail piece. At block 120, the mail pieces are sorted by depositing the mail pieces into the sorting bins in accordance with a first pass sorting scheme. At block 122, if all mail pieces have not been sorted in the first pass, continue to sort at block 120. If all mail pieces have been sorted, at block 124 remove the sorted mail pieces from the sorting bins maintaining the integrity of the first pass sort. At block 126, feed the first pass sorted mail pieces through a bar code reader to initiate a second pass sort. At block 128, the mail pieces are deposited into the sorting bins in accordance with a second pass sorting scheme. At block 130, if all mail pieces have not been sorted in the second pass, continue to sort at block 126. If all the mail pieces have been sorted in the second pass, at block 132 remove the sorted mail pieces from the sorting bins in delivery sequence.

It is therefore, evident that there has been provided in accordance with the present invention a sorting system for organizing mail in the delivery order sequence that fully satisfies the object, aims and advantages set forth above. While this invention has been described in conjunction with specific embodiments thereof, many alternative, modifications and variations will be apparent to those skilled in the art. Accordingly, it is intended to embrace all such alternative, modifications and variations that follow within the spirit and scope of the appended claims.

What is claimed is:

1. A system for sorting mail pieces for delivery by a mail carrier in a sequence corresponding to the mail carrier's route comprising:

a. means for storing a database containing a delivery sequence for each address on the carrier's route;

b. means for feeding the mail pieces to be delivered by the carrier;

c. means coupled to the feeding means for reading an address on each of said fed mail pieces;

d. means, operatively connected to said reading means and said storing means, for determining a sorting sequence representative of said delivery sequence for each of the mail pieces;

e. means for printing on each of the mail pieces a sequence code corresponding to said sorting sequence;

f. sort means operatively connected to said determining means for depositing the mail pieces into sorting bins inn accordance with said sorting sequence wherein number of passes through said sort means and number of sorting bins needed to complete the sorting of the mailpieces always depends on the formula $X=Y^n$, where X equals a maximum number of stops on the letter carrier's route, Y equals the number of said sorting bins in the sorting system and n equals number of passes through the sorting system to complete the sort, the formula holding true for any number of stops.

2. A system for sorting mail pieces in accordance with claim 1 wherein said reading means reads the address of each mail pieces containing a machine readable address.

3. A system for sorting mail pieces in accordance with claim 2 further comprising means for rejecting mail pieces not containing said machine readable address.

4. A system for sorting mail according to claim 1 wherein said sort means for a first pass sort deposits the mail pieces in the following sequence: where S represents each sort bin 1 through Y, and where Y is the total number of bins, the mail pieces containing said sequence codes $(Y\times Z)+S-Y$ are deposited into bin S, with Z equal to 1 through Y.

5. A system for sorting mail pieces in accordance with claim 4 wherein said bins are separately emptied after completion of said first pass sort and the mail pieces from bins 1 through Y are sequentially fed through in reverse order the system for a second pass sort beginning with the mail pieces from bin Y.

6. A system for sorting mail pieces in accordance with claim 4 wherein said bins are separately emptied after completion of said first pass sort and the mail pieces from bins 1 through Y are sequentially fed through the system for a secondn pass sort beginning with the mail pieces from bin 1.

7. A system for sorting mail according to claim 6 wherein said second sort pass comprises:

a. means for reading said sequence code on each mail piece; and b. said sort means depositing each mail piece into one of said sorting bins corresponding to said sequence code.

8. A system for sorting mail pieces in accordance with claim 7 wherein said sort means performs said second pass sort in the following order: mail pieces having said sequence codes of 1 through [X/Y] are deposited into bin 1, mail pieces having sequence codes of [X/Y]+1 through 2 [X/Y] are deposited into bin 2, and the sequence continues through mail pieces having sequence codes of (Y−1)[X/Y]+1 through X are deposited into bin Y.

9. A system for sorting mail according to claim 7 wherein said sequence code is printed in the form of a bar code and said means for reading said sequence code is a bar code reader.

10. A method for sorting mail in a sequence corresponding to a mail carrier's route, comprising the steps of:

(a) storing a database containing a delivery sequence for each address on the carrier's route;

(b) reading in a random order the address on each mail piece received at a local office for delivery by the carrier;

(c) comparing said read address of each piece of mail to addresses contained in said database;

(d) determining the delivery sequence by the carrier for each mail piece;

(e) printing a sequence code on each mail piece representative of the sequence in which the carrier would deliver the mail piece; and performing a multipass sort of the mail pieces in accordance with said sequence code wherein the number of sort passes always is based on a formula $X=Y^n$, wherein X is a maximum number of stops in the carrier's route, Y is a number of sorting bins available for sorting and n is the number of sort passes, the formula holding true for any number of stops.

* * * * *